US007249468B2

(12) United States Patent
Roston

(10) Patent No.: US 7,249,468 B2
(45) Date of Patent: Jul. 31, 2007

(54) AIR CONDITIONING SYSTEM

(76) Inventor: Edward A. Roston, 68 Hicks St., Brooklyn, NY (US) 11201

( * ) Notice: Subject to any disclaimer, the term of this patent is extended or adjusted under 35 U.S.C. 154(b) by 306 days.

(21) Appl. No.: 11/064,184

(22) Filed: Feb. 23, 2005

(65) Prior Publication Data

US 2005/0183451 A1 Aug. 25, 2005

Related U.S. Application Data

(60) Provisional application No. 60/547,401, filed on Feb. 23, 2004.

(51) Int. Cl.
*F25B 39/04* (2006.01)

(52) U.S. Cl. ..... 62/509; 62/126

(58) Field of Classification Search ..... 62/196.4, 62/181, 196.1, 509, 126, 474, 502
See application file for complete search history.

(56) References Cited

U.S. PATENT DOCUMENTS

| | | | | |
|---|---|---|---|---|
| 3,514,967 | A | 6/1970 | Vander | |
| 3,911,693 | A | 10/1975 | Seigler et al. | |
| 3,982,405 | A | 9/1976 | Seigler et al. | |
| 4,059,366 | A | 11/1977 | Gannaway | |
| 4,061,935 | A | 12/1977 | Kandpal | |
| 4,193,781 | A * | 3/1980 | Vogel et al. | 62/81 |
| 4,831,832 | A * | 5/1989 | Alsenz | 62/117 |
| 4,862,702 | A * | 9/1989 | O'Neal | 62/196.4 |
| 5,262,704 | A | 11/1993 | Farr | |
| 5,427,506 | A | 6/1995 | Fry et al. | |
| 5,723,922 | A | 3/1998 | Fowlkes | |
| 5,749,237 | A * | 5/1998 | Sandofsky et al. | 62/209 |
| 5,937,658 | A * | 8/1999 | Black et al. | 62/73 |
| 6,119,472 | A * | 9/2000 | Ross | 62/228.2 |
| 6,244,055 | B1 * | 6/2001 | Hanson et al. | 62/85 |
| 6,357,242 | B1 * | 3/2002 | Farley et al. | 62/133 |
| 6,405,554 | B1 * | 6/2002 | Kawakatu et al. | 62/335 |
| 6,467,303 | B2 * | 10/2002 | Ross | 62/509 |
| 6,542,062 | B1 | 4/2003 | Herrick | |
| 6,634,870 | B2 | 10/2003 | Dreiman et al. | |

* cited by examiner

*Primary Examiner*—Melvin Jones
(74) *Attorney, Agent, or Firm*—Edward A. Sokolski

(57) ABSTRACT

An air conditioning system has a compressor for compressing a liquid refrigerant to form a high pressure vapor which is fed to a condenser for cooling the vapor so that it returns to liquid state and fed to an evaporator. In the evaporator, the liquid is transformed back to a vapor which absorbs heat from the surroundings and provides cooled air. A receiver stores extra refrigerant which is used at low ambient temperatures to flood the condenser to facilitate operation at ambient temperatures which are low compared to the ambient temperatures at which the capacity of the system is rated. A shutoff valve is employed to isolate the high and low pressure elements of the system from each other to enable servicing or pumping down of the system. An accumulator prevents liquid from entering the compressor and a head pressure control maintains a minimum pressure on the high pressure side of the system to assure that the temperature and pressure of the liquid refrigerant remains high enough when the ambient temperature surrounding the condenser is low.

5 Claims, 3 Drawing Sheets

AIR CONDITIONING SYSTEM

This application enjoys the priority of Provisional Application No. 60/547,401 filed Feb. 23, 2004.

BACKGROUND OF THE INVENTION

1. Field of the Invention

This invention relates to air conditioning systems and more particularly to such a system which is capable of severe duty operation in both ordinary and hazardous environments.

2. Description of the Related Art

Normal air conditioner systems are incapable of reliably operating in hazardous environments or environments that demand severe duty operation, particularly where there are wide variations in condensing air or water temperatures. Hazardous environments include those in which there is explosive gaseous material in the atmosphere which might explode in response to heat or a spark generated in the air conditioner systems. Severe duty conditions including widely variant ambient temperatures, high or low ambient temperatures, corrosive material, dust, dirt, humidity sea spray or other undesirable material in the atmosphere also present problems to the normal air conditioner which cannot handle the corrosive clogging or other undesirable effects of the material in the air and cannot handle high variations in ambient temperature. The components of a normal air conditioner also are subject to corrosion or other deterioration from such atmospheric material and this presents an additional problem.

A hazardous duty room air conditioner is described in U.S. Pat. No. 3,982,405 issued Sep. 28, 1976 to Siegler et al. In this patent, the generation of an arc is prevented by using sold state triacs in the switching circuits, contacts made of a metal such as gold which does not tend to arc and in which the switching devices are environmentally sealed. Measures are also provided to prevent frost collection on the evaporator coils during long periods of unattended use by means of a by pass valve connecting the output of the compressor to the input. This closes to connect the output of the compressor to the input when the suction pressure of the compressor goes below a predetermined normal level, thereby returning the evaporator to ambient room temperature to cause the frost to melt. The components of this air conditioner are made of durable material and coated with a corrosion resistant material. To prevent the co-mingling of outside air which may be polluted or contain dust or other undesirable material, a seal is provided between the outside atmosphere and the air within the air conditioner by employing a sealed unit in the portion of the conditioner surrounding the evaporator coils so that ambient outside air will not mix with the air within the conditioner. Water collected in the air conditioner is evaporated by means of a slinger wheel which slings such water onto the hot condenser coil.

SUMMARY OF THE INVENTION

The device of the invention insofar as its basic components go is conventional and employs a compressor which compresses a refrigerant such as Freon to a high pressure vapor, this vapor then being fed to a condenser coil. The vapor is cooled in the condenser by means of a fan and transformed into a liquid state. The liquid coolant is then fed through a filter dryer to an evaporator coil. The evaporator coil is heated to cause the liquid therein to expand rapidly and to transform back into a vapor which absorbs heat from the surroundings. Air is blown over the evaporator by means of a fan which provides cool air for air conditioning a room.

The device of the present invention provides several components not shown in the prior art which make for improved and more efficient air conditioning especially under harsh conditions. These include the following: 1. A Receiver which stores extra refrigerant needed only when the ambient temperature is low compared to the ambient air or condensing water temperature at which its capacity is rated or calculated. This provides extra refrigerant for use at relatively low ambient temperatures and facilitates reaching lower temperatures so that at relatively low ambient temperatures its content is used to partially flood the condenser. This flooding of the condenser combined with the hot gas bypass feature mentioned below, keeps the temperature and pressure of the liquid refrigerant high enough to enable the evaporator to operate correctly even with extremely low ambient temperatures of the air surrounding the condenser. 2. A shutoff valve which can operate to isolate the high pressure elements of the system from the low pressure elements when the system is being serviced or pumped down. 3. An Accumulator which operates to prevent liquid from entering the Compressor which could cause damage. This element is particularly useful when the temperature of the gas returning to the Compressor drops in temperature to the point that drops of liquid start to form in the gaseous refrigerant; 4. Head pressure control maintains a minimum pressure on the high pressure side of the refrigerant system to assure that the temperature and pressure of the liquid refrigerant entering the pressure-relieving device will remain high enough to enable the air conditioner to cool properly, even when air surrounding the condenser has low ambient temperature.

It is therefore an object of this invention to provide an air conditioning system capable of more efficient and more reliable operation particularly under adverse conditions when ordinary air conditioning systems will not function correctly particularly at relatively low ambient temperatures.

It is another object of this invention to provide an improved air conditioning system capable of being used under severe duty operating conditions.

Other objects of the invention will become apparent as the description proceeds in connection with the accompanying drawings.

DETAILED DESCRIPTION OF THE INVENTION

Figure 1:
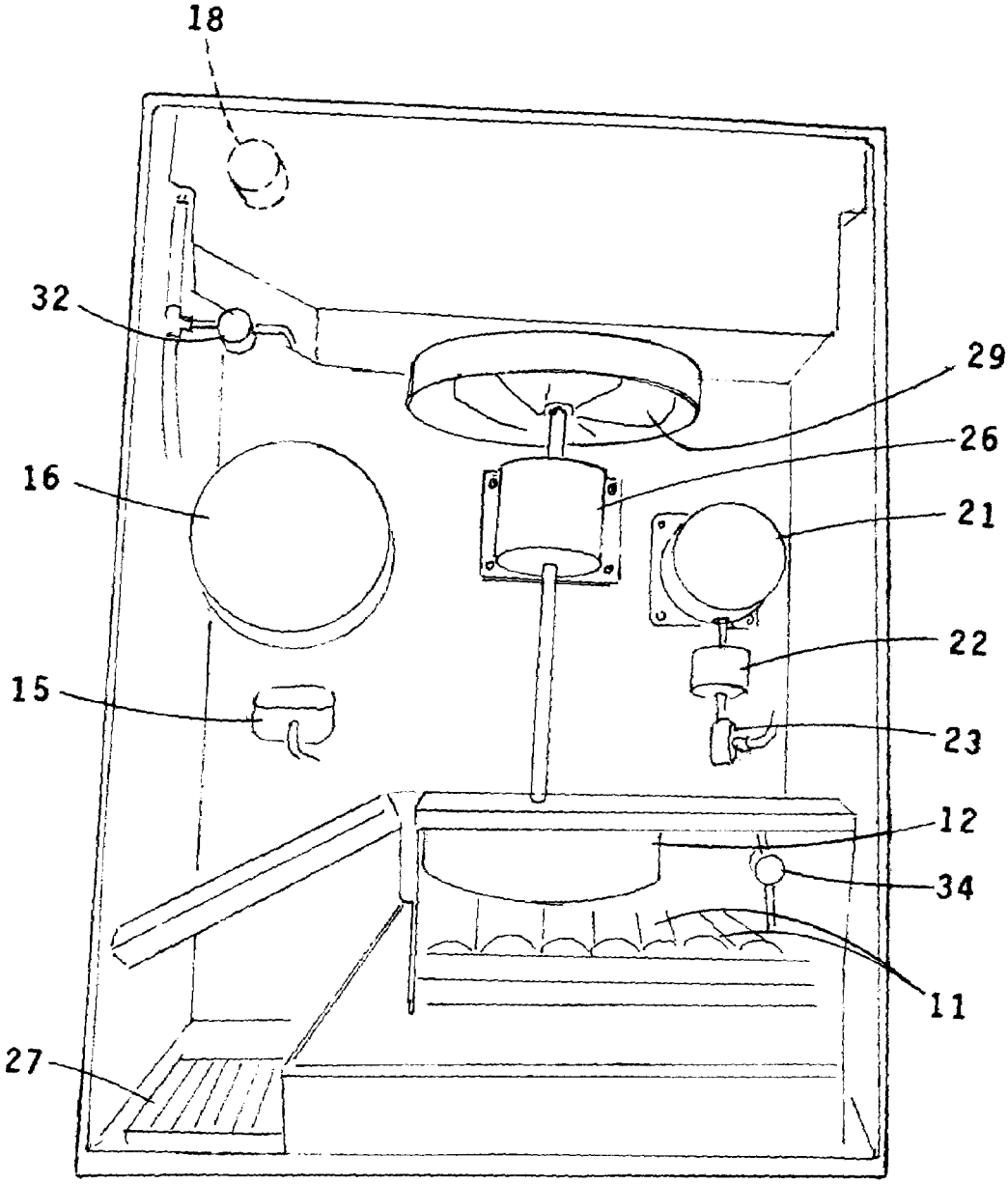
FIG. 1 is pictorial top perspective rear view of a preferred embodiment of the invention.

Referring now to FIG. 1, a preferred embodiment of the invention is shown pictorially outside of the cabinet in which it is normally mounted. The details of the system of the invention will be described in connection with FIGS. 2 and 3.

The components of the system are as follows: Condenser 18 condenses and stores refrigerant in liquid form under low ambient temperatures. Receiver 21 stores extra refrigerant which may be needed under low ambient temperature conditions. Evaporator Coil 11 generates cool air. Blower 12 drives air through the evaporator coil, the cooled air being blown out of the system through outlet 27. The coil is coated with an epoxy to prevent corrosion. Constant pressure valve or thermal expansion valve 34 assures that the Evaporator coil 11 operates properly over a wide temperature range with or without either an internal or external equalizer. Accumulator 15 assures that liquid refrigerant does not enter into the compressor when the ambient temperature is low which could cause damage to the compressor. Compressor 16 and condenser coil 18 are made to have high capacity so that the system can operate efficiently at high altitudes and under high ambient temperatures. Blower motor 26 is of extra power to enable it to drive the fans 29 to move the high volume of air needed under high ambient temperature. Dryer filter 22 removes moisture, dirt and other foreign material from the refrigerant. Sight glass 23 permits viewing of the refrigerant. Head pressure control 32 includes a switch and maintains minimum head pressure in the system. Low pressure switch and shut off valve 13 which detects when the system is running at too low a pressure.

Figure 2:
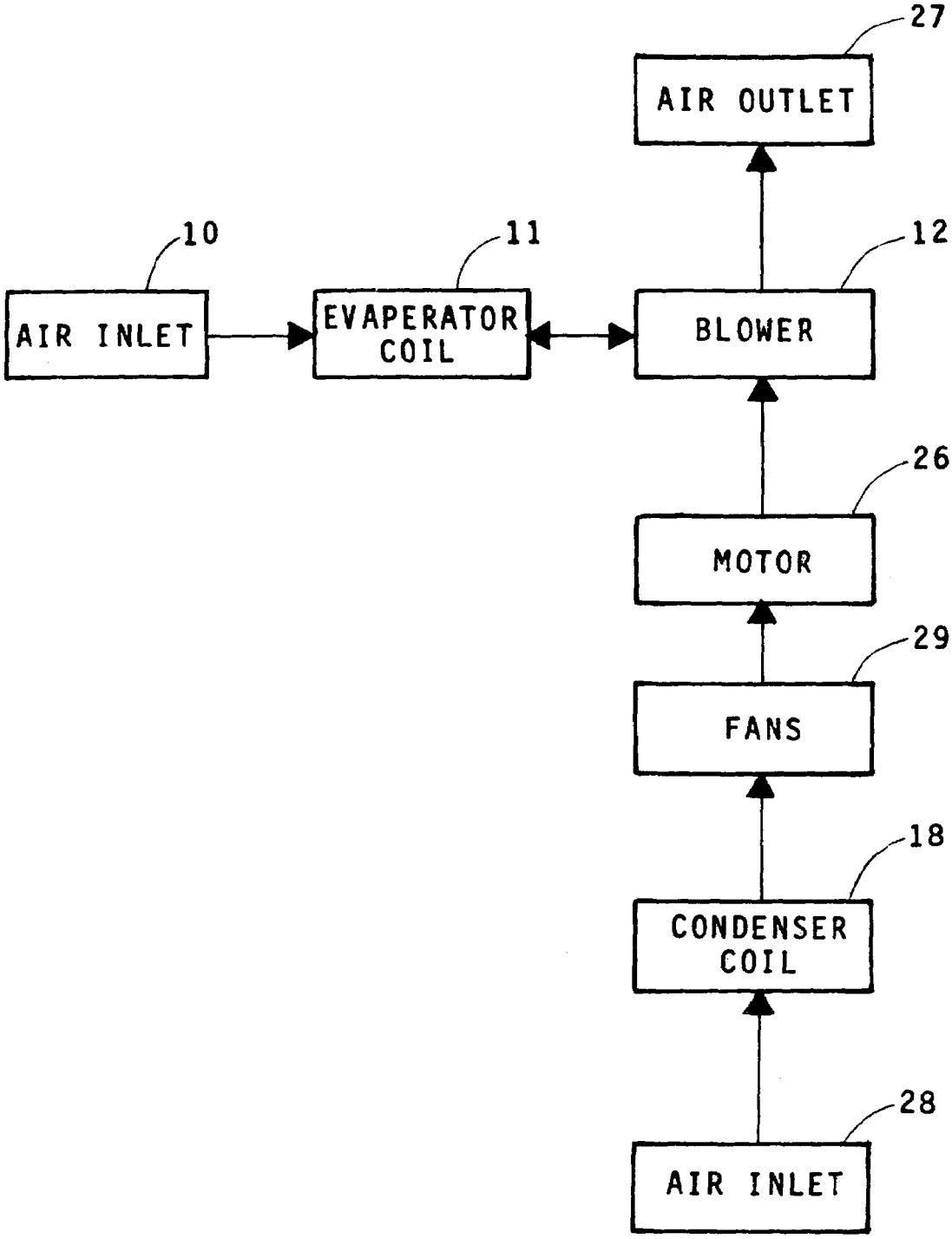
FIG. 2 is a schematic drawing showing the air flow in the preferred embodiment.

Referring now to FIG. 2, an air flow diagram of the system of the invention is illustrated. Motor 26, which may be a model W1PSC motor manufactured by Marathon Electric, Inc., Wausau, Wis. is oversized as compared with motors used in similar systems drives fans 29 which provide air flow needed in various portions of the system. The motor also drives blower 12, which is in the form of a blower wheel contained within the housing. The blower wheel is preferably constructed of corrosion protected aluminum to avoid corrosion and sparking when operating under hazardous conditions. A motor and housing manufactured by Airdex Co, in Barrie, Ontario having 1725 rpm may be employed. The blower blows the cooled area surrounding evaporator coil 11 out to the space to be cooled through outlet 27. Fans 29 blow airs required in various functions of the system as noted further on in the specification.

Ambient air is drawn in from outside the space to be cooled by a suction (one of fans 29) through air inlet 28 onto condenser coil 18. and cools the condenser to transform the vapor therein to a liquid state. The coil is coated with a plastic material to prevent corrosion. Such condenser coils are manufactured by Super Radiator Coils in Minneapolis, Minn.

Air is drawn in from the outside through air inlet 10 onto evaporator coil 11. The coil is coated with epoxy to prevent corrosion. This unit can be purchased from Super Radiator Coils, in Minneapolis, Minn. The blower blows against the evaporator coil and the cooled air generated by the cool evaporator coil is blown out through air outlet 27.

Figure 3:
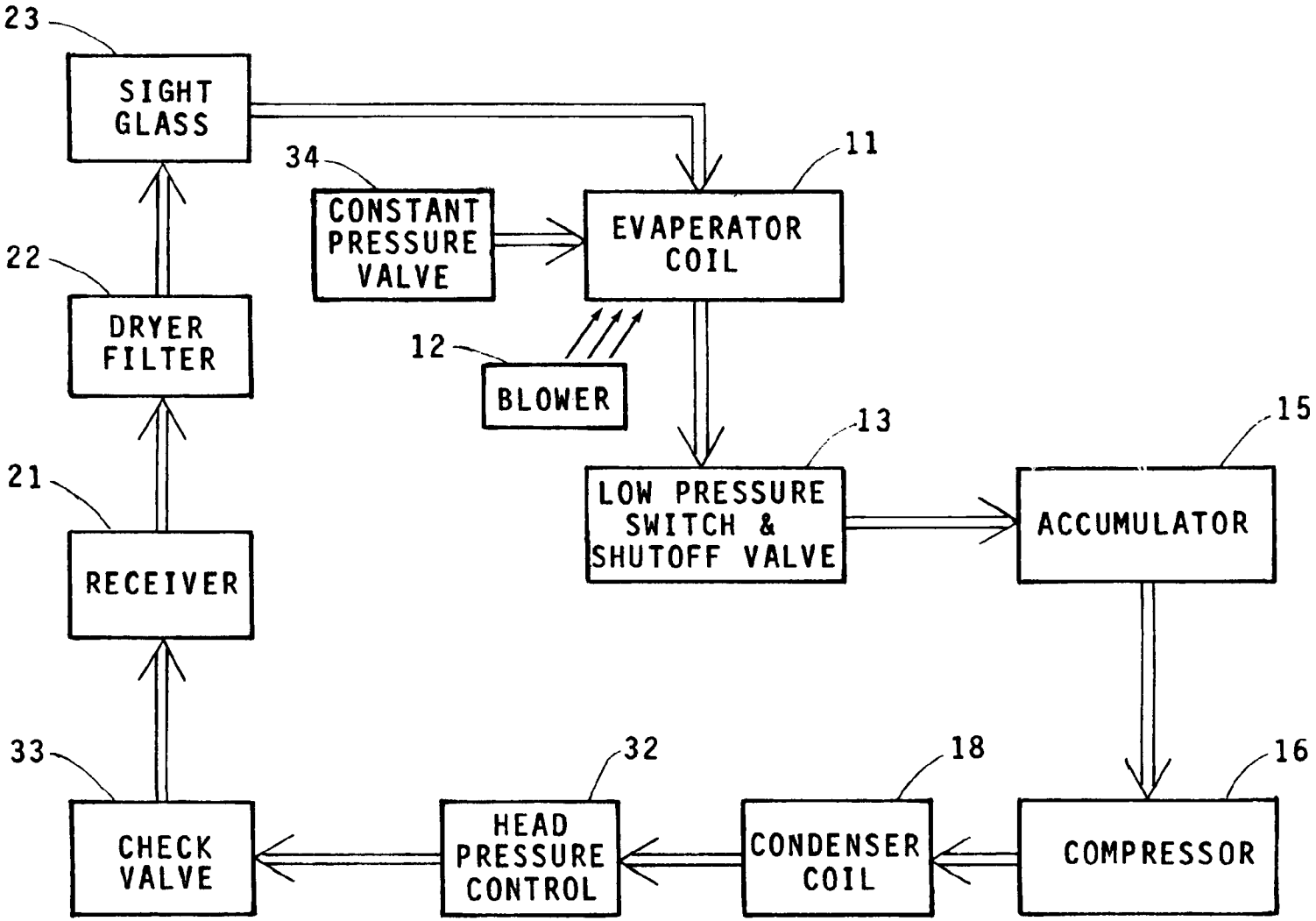
FIG. 3 is a schematic drawing showing the flow of the refrigerant in the preferred embodiment.

Referring now to FIG. 3, a functional block diagram of the refrigeration system of the invention is illustrated.

Compressor 16 compresses a liquid refrigerant such as Freon to a high pressure vapor. The compressor may be a unit available from Bristol Compressors, Bristol, Va. The pressurized refrigerant gas is fed from the compressor to condenser coil 18. This unit is available from Super Radiator Coils, Minneapolis, Minn. The pressurized refrigerant is cooled by a fan driving outside ambient air to which the coils are exposed, to bring the refrigerant back to a liquid state. The output of the condenser coil is fed to head pressure control 32 which maintains a minimum head pressure in the system and prevents the system from dropping in pressure far enough such that the evaporator loses capacity or otherwise does not function properly. This unit is available from Emerson Flow Controls, St. Louis, Mo. The output of the head pressure control is fed through a check valve 33 which is a mechanical valve available as unit ACK6 from Alco Corp and permits flow in only one direction (i.e. the direction indicated in the drawing).

From the check valve the refrigerant is fed to receiver 21. The receiver unit, which includes an integral shut off valve is part no. 9516 of Refrigeration Research, Brighton, Mich. The receiver accumulates reserve liquid refrigerant, provides storage of the refrigerant during off-peak operation, allows for operation at extremely low ambient temperatures, and permits pumping down of the system. It also has a shut off valve which serves as a seal against the entry of gaseous refrigerant into the liquid line.

The liquid refrigerant is then fed to dryer filter 22 which removes moisture, dirt and other foreign material from the refrigerant. Such a unit is part no. DUK 03 3S available from Emerson Flow Controls, St. Louis, Mo. The refrigerant is fed through a sight glass 23 to permit viewing. Such a sight glass is part no. AM1-1TT3 available from Emerson Flow Controls, St. Louis, Mo.

The liquid refrigerant is then fed to evaporator coil 11. The evaporator coil operates in conventional fashion to evaporate the liquid refrigerant in response to the surrounding air and a heater to bring it to gaseous form. In this process, the heat in the surrounding air is absorbed by the refrigerant passing through the evaporator. Constant pressure or thermal expansion valve 34 operates with or without an internal or external equalizer to maintain a constant pressure in the evaporator. This valve, which may be part no. A7-B available from Parker Hannifin Co., Cleveland, Ohio, feeds enough liquid refrigerant to the evaporator to maintain a constant liquid flow no matter what the temperature of the liquid entering the valve may be.

Blower 12 sucks air through the outside of the cooled evaporator coil to provide the cool air output of the system. The refrigerant in the evaporator coil is fed through a low pressure switch and shut off valve 13. This low pressure switch of the low pressure switch and shut off valve assembly 13 detects when the system is running at too low a pressure which could among other things lead to the development of frost on the evaporator and operates to cut off power to the device. The shutoff valve also can be used to isolate the high pressure portion of the system from the low pressure portion should the user want to pump down the system or to make repairs. The low pressure switch can be model no. PS80-K2-FO316 available from the Texas Instruments Co., Dallas, Tex. and the shut off valve can be model no. ABV5 available from Emerson Flow Controls, St. Louis, Mo.

Under normal operation, the refrigerant is fed from the evaporator coil to Accumulator 15, the output of which is fed to compressor 16. The Accumulator could be model no. 3703 of the Refrigeration Research Company, Brighton, Mich. The Accumulator prevents the entry of liquid into the compressor which could cause damage since liquids cannot be compressed. Such liquid might be generated in the system in the form of drops when the ambient temperature drops to a very low level.

While particular components from various manufacturers have been identified for each of the components of the system, other components which are equivalent in operation might be employed.

While the use of copper tubing to interconnect the components have been shown, rubber tubing could also be used to withstand high vibrations where the situation so demands.

While the invention has been described and illustrated in detail, it is be clearly understood that this is intended by illustration and example only, the coverage of the patent being limited only by the terms of the following claims.

I claim:

1. In an air conditioning system having a compressor for compressing a low pressure gaseous refrigerant to form a high pressure vapor, a condenser to which the high pressure vapor is fed and in which the vapor is cooled and returned to a liquid state, and an evaporator to which the liquid refrigerant in the condenser is fed and in which the liquid refrigerant is transformed to a vapor and absorbs heat from the surroundings to cool the surrounding air, the improvement comprising:

a receiver connected between the condenser and the evaporator, said receiver storing extra refrigerant received from the condenser for use at low ambient temperatures, said receiver including a shut off valve which isolates the high and low pressure elements of the system from each other;

a low pressure switch and shut off valve assembly connected between the evaporator and the compressor, said low pressure switch of said assembly detecting when the system is running at too low pressure and in response to such a detection shutting off the system;

a head pressure control connected between the condenser and the evaporator, said head pressure control maintaining a minimum pressure in the high pressure portion ot the system; and a constant pressure valve connected to the evaporator for maintaining a constant pressure to the evaporator.

2. The system of claim 1 wherein said constant pressure valve includes an equalizer.

3. In an air conditioning system having a compressor for compressing a low pressure gaseous refrigerant to form a high pressure vapor, a condenser to which the high pressure vapor is fed and in which the vapor is cooled and returned to a liquid state, and an evaporator to which the liquid refrigerant in the condenser is fed and in which the liquid refrigerant is transformed to a vapor and absorbs heat from the surroundings to cool the surrounding air, the improvement comprising:

a receiver connected between the condenser and the evaporator, said receiver storing extra refrigerant received from the condenser for use at low ambient teniperatures, said receiver including a shut off valve which isolates the high and low pressure elements of the system from each other;

a head pressure control connected between the condenser and the evaporator, said head pressure control maintaining a minimum pressure in the high pressure portion of the system; and a constant pressure valve connected to the evaporator for maintaining a constant pressure in the evaporator.

4. The system of claim 3 and further including a low pressure switch connected between the evaporator and the compressor, said low pressure switch shutting off the system when the system is running at too low a pressure.

5. In an air conditioning system having a compressor for compressing a low pressure gaseous refrigerant to fain a high pressure vapor, a condenser to which the high pressure vapor is fed and in which the vapor is cooled and returned to a liquid state, and an evaporator to which the liquid refrigerant in the condenser is fed and in which the liquid refrigerant is transformed to a vapor and absorbs heat from the surroundings to cool the surrounding air, the improvement comprising:

a receiver connected between the condenser and the evaporator, said receiver storing extra refrigerant received from the condenser for use at low ambient temperatures, said receiver including a shut off valve which isolates the high and low pressure elements of the system from each other; and a low-pressure switch connected between the evaporator and the compressor, said low-pressure switch shutting down the system when the system is running at too low a pressure.

* * * * *